United States Patent [19]

Moriyama

[11] Patent Number: 4,658,546

[45] Date of Patent: Apr. 21, 1987

[54] WINDOWPANE LIFTING MECHANISM FOR VEHICLE DOOR

[75] Inventor: Yukihiro Moriyama, Hiroshima, Japan

[73] Assignee: Mazda Motor Corporation, Hiroshima, Japan

[21] Appl. No.: 783,597

[22] Filed: Oct. 3, 1985

[30] Foreign Application Priority Data

Oct. 11, 1984 [JP] Japan ..... 59-213599
Oct. 11, 1984 [JP] Japan ..... 59-153799[U]

[51] Int. Cl.[4] ..... E05F 11/48

[52] U.S. Cl. ..... 49/352; 49/227; 49/374

[58] Field of Search ..... 49/352, 227, 360, 374, 49/375, 40

[56] References Cited

U.S. PATENT DOCUMENTS

| | | | |
|---|---|---|---|
| 3,078,120 | 2/1963 | Faber | 49/227 |
| 3,093,404 | 6/1963 | Probst | 49/227 X |
| 3,646,707 | 3/1972 | Lystad | 49/227 |
| 4,001,971 | 1/1977 | Gobush et al. | 49/227 X |
| 4,547,993 | 10/1985 | Kobayashi et al. | 49/360 X |

*Primary Examiner*—Kenneth Downey
*Attorney, Agent, or Firm*—Gerald J. Ferguson, Jr.; Michael P. Hoffman; Ronni S. Malamud

[57] ABSTRACT

A windowpane lifting mechanism comprises a cable member which is provided to vertically extend in a door shell and connected to a lower end portion of a windowpane by way of a connecting member so that the windowpane is moved up and down to close and open the window in response to up-and-down running of the cable member. The windowpane lifting mechanism further includes a first guide rail member which is provided on one side of the cable member to linearly extend substantially in the vertical direction, a second guide rail member provided to extend substantially in the vertical direction in nonparallel relation to the first guide rail member spaced therefrom by a predetermined distance in the direction of width of the windowpane, a first slider connected to a lower portion of the windowpane and engaged with the first guide rail member to be slidable along the first guide rail member, a second slider connected to a lower portion of the windowpane at a distance from the first slider and engaged with the second guide rail member to be slidable along the second guide rail member.

20 Claims, 12 Drawing Figures

WINDOWPANE LIFTING MECHANISM FOR VEHICLE DOOR

BACKGROUND OF THE INVENTION

1. Field of the Invention

This invention relates to a windowpane lifting mechanism for a vehicle door, and more particularly to a cable-type windowpane lifting mechanism for a vehicle door for lifting and lowering a windowpane of a vehicle door by way of a cable to open and close the window.

2. Description of the Prior Art

In an automobile, when lowering the windowpane of a front door into the door interior, the windowpane must be lowered first inclined forward in order to prevent interference with a door lock device disposed at a rear portion in the door panel and then gradually erected toward the original upright position in order to avoid collision of the front edge of the windowpane with a front wall portion of the door panel. Further, when lowering the windowpane of a rear door into the door interior, the windowpane must be lowered inclined forward in order to avoid interference with a wall portion defining a cutaway portion which is formed on the rear side of the door panel to accommodate a tire house. Such requirement on the action of the windowpane is especially significant in a hardtop type car in which the windowpane has a large area and no window sash is provided.

As a windowpane lifting mechanism, there has been in wide use a so-called X-link type windowpane lifting mechanism. For example, see Japanese Unexamined Utility Model Publication No. 57(1982)-88866. Generally, the X-link type windowpane lifting mechanism comprises a main arm member which is provided on the lower end thereof with a sector gear in mesh with a pinion supported on the door panel and the upper end of which is slidably connected to a windowpane holder mounted on the lower end of the windowpane, an auxiliary arm member which is pivoted on the main arm member, and is connected to the door panel for sliding movement at the lower end thereof and to the windowpane holder for sliding movement at the upper end thereof, and a guide rail member such as a sash for guiding the windowpane in up-and-down movement. In the lifting mechanism, the windowpane is moved up and down by rotation of the pinion by way of the main and auxiliary arm members.

Though being advantageous in that the windowpane can be held rigidly since a link mechanism is used, the X-link type windowpane lifting mechanism is disadvantageous in that the link mechanism occupies a large space in the internal space of the door to complicate the structure inside the door and to increase the overall weight of the same, and that the force required to lift and lower the windowpane varies with the vertical position of the windowpane.

On the other hand, there has been known a cable-type windowpane lifting mechanism as is disclosed, for instance, in Japanese Unexamined Utility Model Publication No. 58(1983)64778. The cable-type windowpane lifting mechanism comprises a cable member which is provided to vertically extend in the door interior and is connected to a lower end portion of the windowpane by way of a connecting member, and a guide rail member for guiding the windowpane in up-and-down movement. The windowpane is moved up and down to close and open the window by running the cable member upward and downward. The cable-type windowpane lifting mechanism is advantageous in that it is small in weight and occupies relatively small space in the internal space of the door and in that the force for lifting and lowering the windowpane is substantially constant. However, there arises a problem that in the cable-type windowpane lifting mechanism, the windowpane holding rigidity is relatively weak and accordingly it is difficult to move up and down the windowpane in an inclined state. Therefore, said requirement on the action of the windowpane during up-and-down movement is difficult to satisfy in the cable-type windowpane lifting mechanism.

SUMMARY OF THE INVENTION

In view of the foregoing observations and description, the primary object of the present invention is to provide a cable-type windowpane lifting mechanism which can satisfy said requirement on the action of the windowpane during up-and-down movement.

The windowpane lifting mechanism in accordance with the present invention includes a windowpane driving means comprising a cable member which is provided to vertically extend in a door shell and connected to a lower end portion of a windowpane by way of a connecting member so that the windowpane is moved up and down to close and open the window in response to up-and-down running of the cable member. The windowpane lifting mechanism further includes a windowpane guiding means comprising a first guide rail member which is provided on one side of the cable member to linearly extend substantially in the vertical direction, a second guide rail member provided to extend substantially in the vertical direction in nonparallel relation to the first guide rail member spaced therefrom by a predetermined distance in the direction of width of the windowpane, a first slider connected to a lower portion of the windowpane and engaged with the first guide rail member to be slidable along the first guide rail member, a second slider connected to a lower portion of the windowpane at a distance from the first slider and engaged with the second guide rail member to be slidable along the second guide rail member.

When the cable member is run upward or downward, the windowpane is lifted or lowered under the guidance of the engagement of the first guide rail member and the first slider and the engagement of the second guide rail member and the second slider. Since the second guide rail member is in nonparallel relation to the first guide rail member and the distance between the first and second sliders is fixed, a difference in displacement is produced between the first and second sliders while the windowpane is lifted or lowered. By virtue of the difference in displacement, the windowpane can undergo the action required to be moved up and down without interference with other parts such as a door lock device.

In accordance with a preferred embodiment of the present invention, said first slider is arranged not to permit displacement of the windowpane in the direction of thickness of the door during up-and-down movement of the windowpane and on the other hand, the second slider is arranged to permit displacement of the windowpane in the direction of thickness of the door during up-and-down movement of the windowpane. At the same time, two pairs of stabilizers are provided adjacent to the upper edge of the door shell. The pairs of stabilizers are spaced from each other in the direction of width of the windowpane and the stabilizers of each pair are opposed to each other on opposite sides of the windowpane and are in a sliding contact with the windowpane to restrict displacement of the windowpane in the direction of thickness of the door.

By restricting displacement of the windowpane in the direction of thickness of the door at three points and at three points only, the windowpane can be smoothly lifted and lowered without being twisted.

The present state of the art is disclosed in Japanese Unexamined Utility Model Publication Nos. 57(1982)88866, 57(1982)-88867 and 58(1983)-64778, for instance.

DESCRIPTION OF THE PREFERRED EMBODIMENTS

Figure 2:
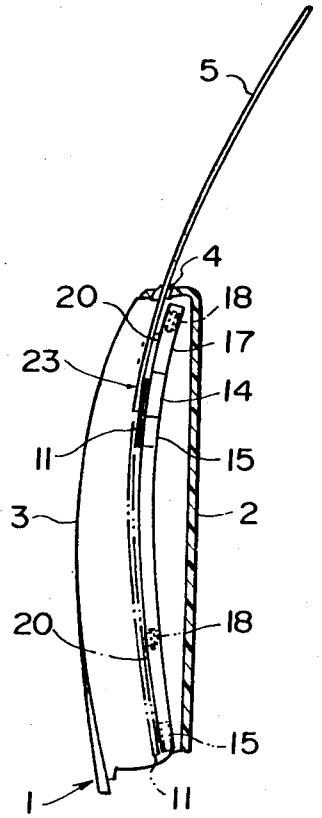
FIG. 2 is a cross-sectional view taken along line II—II in FIG. 1.
Figure 1:
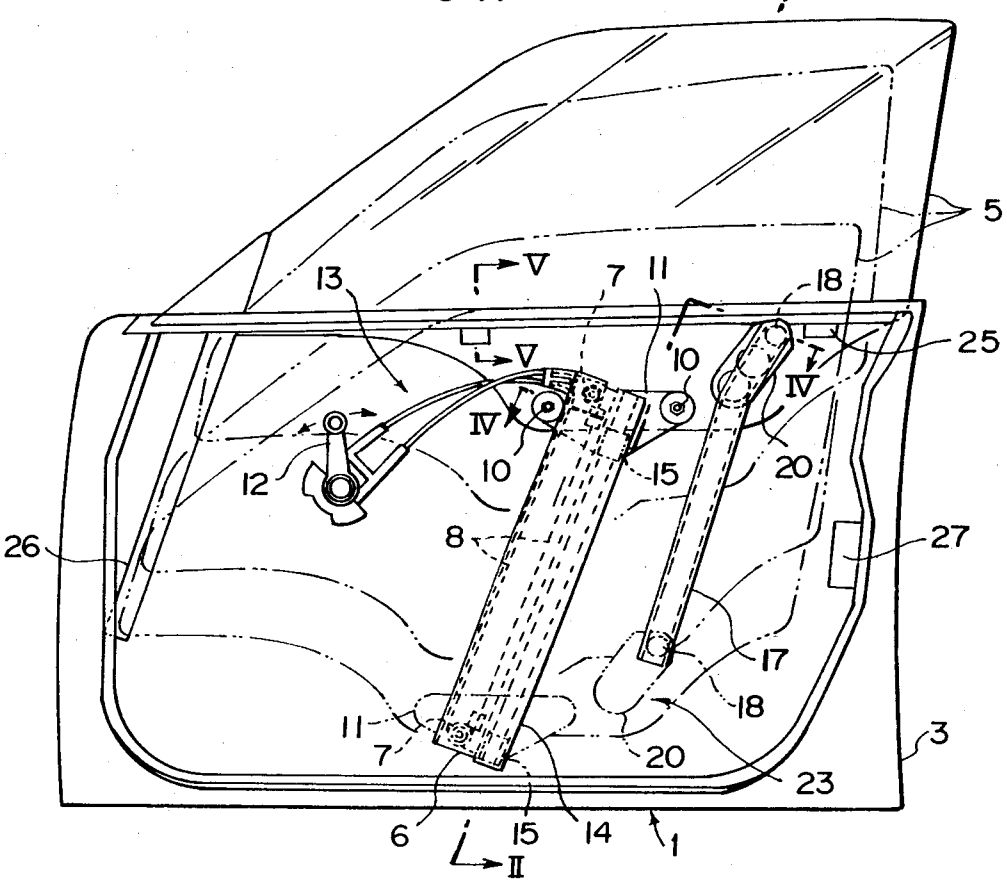
FIG. 1 is a front elevational view of a front door in which a windowpane lifting mechanism in accordance with a first embodiment of the present invention is incorporated.
Figure 3:
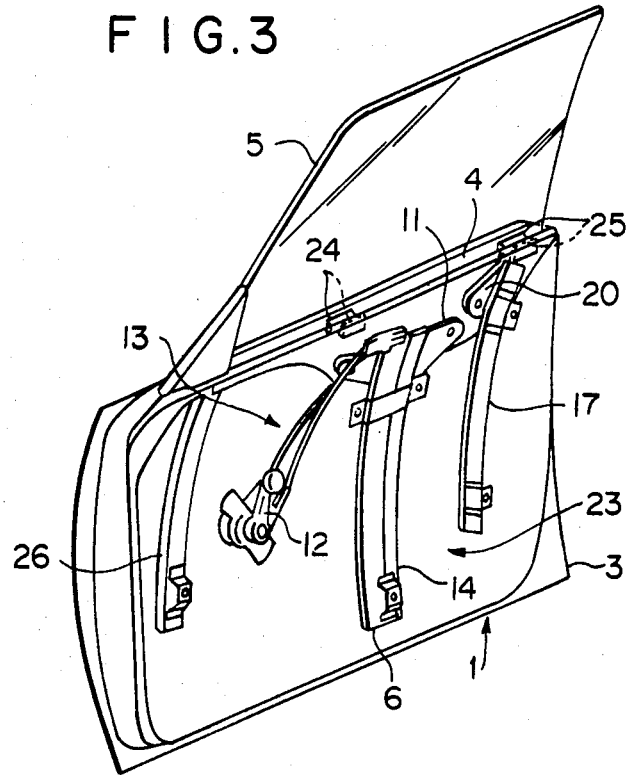
FIG. 3 is a perspective view of the front door shown in FIG. 1.

In FIGS. 1 to 3, a door shell 1 for a front door comprises an inner panel 2 and an outer panel 3 integrally connected with each other. An opening 4 is formed in the upper edge of the door shell 1 and a windowpane 5 is lifted and lowered through the opening 4 to close and open the window.

A regulator base 6 is mounted on the inner surface of the inner panel 2 substantially at the middle between the front and rear ends of the door shell 1 to extend substantially vertically. A pair of pulleys 7 are respectively supported for rotation on upper and lower end portions of the inner surface of the regulator base 6. A cable member 8 is passed around the pulleys 7 to extend substantially vertically. A connecting member 11 in the form of a triangular plate is connected to an intermediate portion of the cable member 8. The connecting member 11 is attached to the lower end portion of the windowpane 5 by bolts 9 and nuts 10.

Both end portions of the cable member 8 is wound around and fixed to a rotary drum (not shown) supported for rotation on the inner surface of the inner panel 2 forward of the regulator base 6. The supporting shaft of the rotary drum extends through the inner panel 2 into the passenger compartment and a regulator handle 12 is attached to the end of the supporting shaft projecting into the passenger compartment. When the regulator handle 12 is rotated, the rotary drum is rotated to run the cable member 8 upward or downward and the windowpane 5 is moved upward (to close the window) or downward (to open the window) depending on the direction of the movement of the cable member 8 or the direction of rotation of the regulator handle 12. That is, the cable member 8, regulator handle 12 and the parts associated therewith form a windowpane driving means 13. As clearly shown in FIG. 4, to the rear edge portion of the regulator base 6 is integrally coupled a first guide rail member 14 which is shaped like outwardly opening C in cross section and is disposed in parallel to the cable member 8. That is, the first guide rail member 14 linearly extends substantially in the vertical direction on the rear side of the cable member 8 adjacent thereto.

Figure 4:
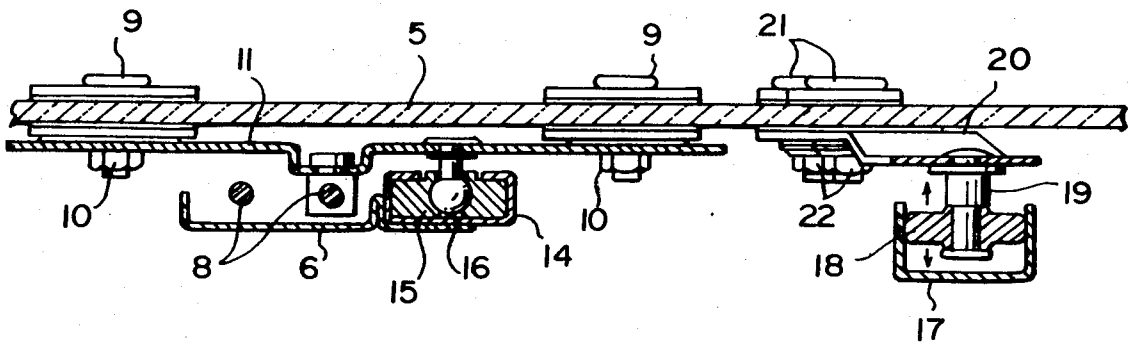
FIG. 4 is an enlarged cross-sectional view taken along line IV—IV in FIG. 1.

A first slider 15 is fit into the first guide rail member 14 so that the first slider 15 can slide along the first guide rail member 14 but cannot be displaced (by virtue of the cross-sectional shape of the first guide rail member 14 which is partly closed outwardly) in the direction of thickness of the door, i.e., in the vertical direction as seen in FIG. 4. The first slider 15 is connected to the connecting member 11 by way of a connecting shaft 16 to be rotatable with respect to the connecting member 11.

A second guide rail member 17 is mounted on the inner surface of the inner panel 2 rearwardly spaced from the first guide rail member 14 by a predetermined distance to extend substantially in the vertical direction. The second guide rail member 17 is substantially U-shaped in cross section and opens outwardly. The second guide rail member 17 is bent into a predetermined shape and accordingly extends in nonparallel relation to the first guide rail member 14.

A second slider 18 which is a roller in this particular embodiment is fit into the second guide rail member 17 to be slidable along the second guide rail member 17 and to be able to be displaced in the direction of thickness of the door by virtue of the cross-sectional shape of the second guide rail member 17 which is completely opened outwardly. The second slider 18 is connected to a bracket 20 by way of a connecting shaft 19 to be rotatable with respect to the bracket 20. The base portion of the bracket 20 is fixed, by bolts 21 and nuts 22, to the lower portion of the windowpane 5 rearwardly spaced from the first slider 15 by a predetermined distance.

Figure 5:
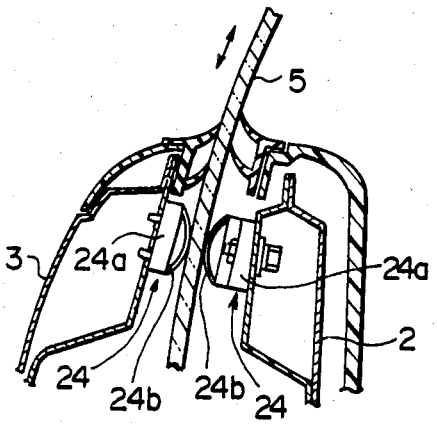
FIG. 5 is an enlarged cross-sectional view taken along line V—V in FIG. 1.

A pair of stabilizers 24 are respectively attached to upper portions of the inner and outer panels 2 and 3 immediately below the opening 4 to be opposed to each other. Another pair of stabilizers 25 are respectively attached to upper portions of the inner and outer panels 2 and 3 immediately below the opening 4 to be opposed to each other rearwardly spaced from the stabilizers 24. As clearly shown in FIG. 5 in which the forward pair of stabilizers 24 are shown by way of example, each of the stabilizers 24 and 25 comprises a base portion (24*a*) and Teflon bristle cloth (24*b*) having lubricity and bonded to the surface of the base portion. The stabilizers 24 and 25 are in contact with the windowpane 5 at the Teflon bristle cloth portion. When the windowpane 5 is moved up or down to close or open the window, displacement of the windowpane 5 in the direction of thickness of the door is restricted by the stabilizers 24 and 25 and the first guide rail member 14, and at the same time, forward and rearward displacement of the windowpane 5 is restricted by engagement of the first slider 15 and the first guide rail member 14 and engagement of the second slider 18 and the second guide rail member 17. When the windowpane 5 is lowered, the windowpane 5 is once forwardly inclined and then gradually erected to the original upright portion by virtue of the shape of the second guide rail member 17. Thus, the first and second guide rail members 14 and 17, the stabilizers 24 and 25, and the parts associated therewith form a windowpane guiding means 23.

In FIGS. 1 to 3, reference numeral 26 denotes a channel shaped guide rail which holds the front edge of the windowpane 5 to restrict displacement of the front edge in the direction of thickness of the door, and reference numeral 27 denotes a door lock disposed in a rear portion of the door shell 1.

When the regulator handle 12 is manually rotated, the cable member 8 is run in the regulator base 6 upward or downward depending on the direction of the rotation of the regulator handle 12 and the windowpane 5 is lifted or lowered by way of the connecting member 11. While the windowpane 5 is lifted or lowered, the position of the windowpane 5 is restricted by the first and second sliders 15 and 18 respectively in engagement with the first and second guide rail members 14 and 17, and the stabilizers 24 and 25 in contact with the both sides of the windowpane 5.

Since the second guide rail member 17 is bent and extends in nonparallel relation to the first guide rail member 14, and the distance between the first and second sliders 15 and 18 is fixed, a difference in displacement is produced between the first and second sliders 15 and 18 while the windowpane 5 is lowered. By virtue of the difference in displacement, the windowpane 5 is once forwardly inclined and then erected toward the upright position as it is lowered, whereby the windowpane 5 can be lowered into the door shell 1 without being interfered with by the door lock 27.

Since the first slider 15 is engaged with the first quide rail member 14 so as not to permit displacement of the first slider 15 in the direction of thickness of the door and the second slider 18 is engaged with the second guide rail member 17 to permit displacement of the second slider 18 in the direction of thickness of the door, displacement of the windowpane 5 in the direction of the thickness of the door during up-and-down movement is restricted at only three points, i.e., the contact points of the stabilizers 24 and 25 and the mounting point of the first slider 15. Therefore, the windowpane 5 can be smoothly lifted and lowered without being twisted.

Figure 6:
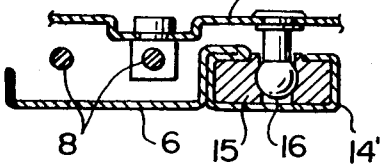
FIG. 6 is a cross-sectional view showing a modification of the first guide rail member employed in the windowpane lifting mechanism of the first embodiment.

The first guide rail member 14 is formed separately from the regulator base 6 and coupled thereto in the above embodiment. However, they may be integrally formed from a single plate member as indicated at 14' and 6' in FIG. 6.

Figure 8:
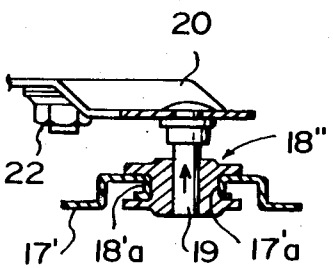
FIGS. 7 and 8 are cross-sectional views respectively showing modifications of the second guide rail member employed in the windowpane lifting mechanism of the first embodiment.
Figure 7:
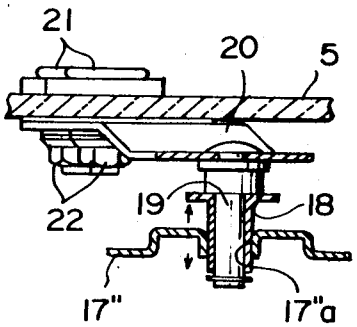

FIG. 7 and 8 respectively show modifications of the second guide rail member and the second slider. In the modification shown in FIG. 7, a second guide rail member 17' is provided with a substantially vertically extending guide groove 17'*a*, and a second slider 18' is provided in the form of a cylindrical roller fit into the guide groove 17'*a* to be slidable in the axial direction. In the modification shown in FIG. 8, a second guide rail member 17'' is similar to the second guide rail member 17' shown in FIG. 7 and is provided with a substantially vertically extending guide groove 17''*a*, and a second slider 18'' is in the form of a sheave having an annular groove 18''*a*. The annular groove 18''*a* is engaged with the second guide rail member 17'' to permit sliding movement of the second slider 18'' along the guide groove 17''*a*, and the second slider 18'' receives the connecting shaft 19 to be slidable in the axial direction, thereby permitting displacement of the windowpane 5 in the direction of the thickness of the door.

Figure 9:
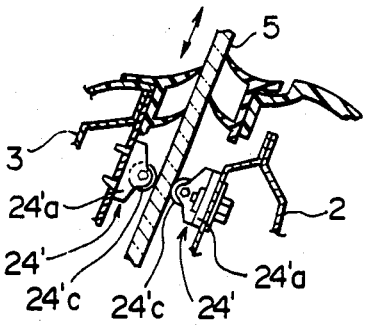
FIG. 9 is a view similar to FIG. 5 but showing a modification of the stabilizer employed in the windowpane lifting mechanism of the first embodiment.

Instead of the stabilizers 24 and 25 comprising the base portion (24*a*) and the Teflon bristle cloth (24*b*), stabilizers 24' comprising a base portion 24'*a* and a roller 24'*c* rotatably supported thereon as shown in FIG. 9 may be used.

Figure 11:
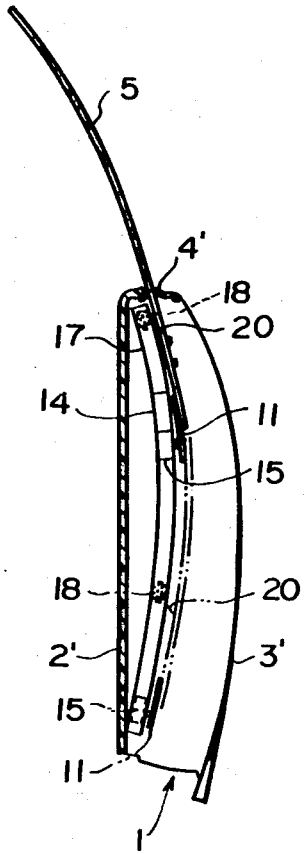
FIG. 11 is a cross-sectional view taken along line XI—XI in FIG. 10.
Figure 10:
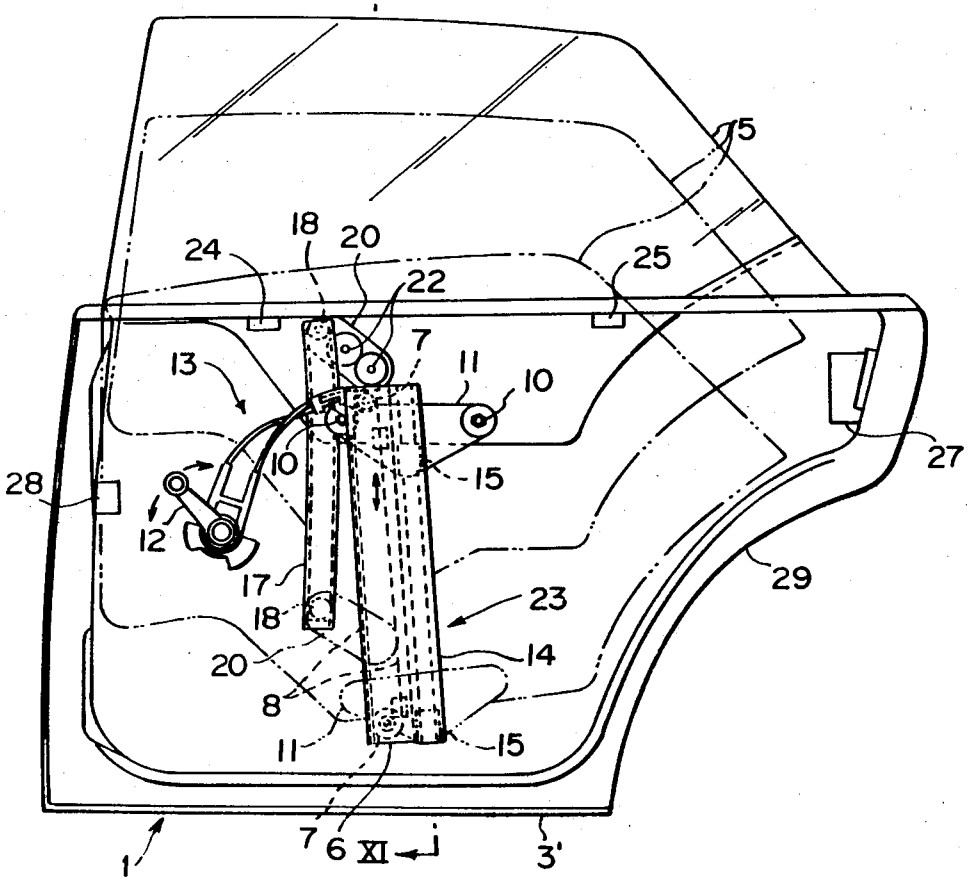
FIG. 10 is a front elevational view of a rear door in which a windowpane lifting mechanism in accordance with a second embodiment of the present invention is incorporated.

FIGS. 10 and 11 show a rear door in which a windowpane lifting mechanism in accordance with another embodiment of the present invention is incorporated. In FIGS. 10 and 11, the parts corresponding to the parts shown in FIGS. 1 to 3 are given the same reference numerals and will not be described in detail here.

In this example, a windowpane driving means is formed by a regulator base 6 mounted in a door shell 1' for a rear door, and a cable member 8 provided along the regulator base 6 to be run up and down by rotation of a regulator handle 12 to lift and lower a windowpane 5 by way of a connecting member 11.

A first guide rail member 14 is disposed rearward of the cable member 8 to extend linearly in parallel to the cable member 8. A first slider 15 connected to the connecting member 11 is engaged with the first guide rail member 14 to be slidable along the first guide rail member 14 and to be unable to be displaced in the direction of thickness of the door.

A second guide rail member 17 is mounted forwardly spaced from the first guide rail member 14 by a predetermined distance to extend substantially in the vertical direction. The second guide rail member 17 is bent into a predetermined shape and accordingly extends in nonparallel relation to the first guide rail member 14.

A second slider 18 is fit into the second guide rail member 17 to be slidable along the second guide rail member 17 and to be able to be displaced in the direction of thickness of the door. The second slider 18 is connected to the lower portion of the windowpane 5 by way of a bracket 20 forwardly spaced from the first slider 15 by a predetermined distance.

A pair of stabilizers 24 are respectively attached to upper portions of the inner and outer panels 2 and 3 immediately below the opening 4 to be opposed to each other. Another pair of stabilizers 25 are respectively attached to upper portions of the inner and outer panels 2 and 3 immediately below the opening 4 to be opposed to each other rearwardly spaced from the stabilizers 24. When the windowpane 5 is moved up or down to close or open the window, displacement of the windowpane 5 in the direction of thickness of the door is restricted by the stabilizers 24 and 25 and the first guide rail member 14, and at the same time, forward and rearward displacement of the windowpane 5 is restricted by engagement of the first slider 15 and the first guide rail member 14 and engagement of the second slider 18 and the second guide rail member 17. When the windowpane 5 is lowered, the windowpane 5 is forwardly inclined by virtue of the shape of the second guide rail member 17. Thus, the first and second guide rail members 14 and 17, the stabilizers 24 and 25, and the parts associated therewith form a windowpane guiding means 23.

In FIG. 10, reference numeral 28 denotes a channel shaped guide rail which holds the front edge of the windowpane 5 to restrict displacement of the front edge in the direction of thickness of the door. A cutaway portion 29 is formed in the rear portion of the door shell 1' in order to prevent interference of the door with a tire house for accommodating a rear tire.

While the windowpane 5 is lifted or lowered, the position of the windowpane 5 is restricted by the first and second sliders 15 and 18 respectively in engagement with the first and second guide rail members 14 and 17, and the stabilizers 24 and 25 in contact with the both sides of the windowpane 5.

Since the second guide rail member 17 is bent and extends in nonparallel relation to the first guide rail member 14, and the distance between the first and second sliders 15 and 18 is fixed, a difference in displacement is produced between the first and second sliders 15 and 18 while the windowpane 5 is lowered. By virtue of the difference in displacement, the windowpane 5 is forwardly inclined as it is lowered, whereby the windowpane 5 can be lowered into the door shell 1' without being interfered with by the wall portion defining the cutaway portion 29.

Since the first slider 15 is engaged with the first guide rail member 14 so as not to permit displacement of the first slider 15 in the direction of thickness of the door and the second slider 18 is engaged with the second guide rail member 17 to permit displacement of the second slider 18 in the direction of thickness of the door, displacement of the windowpane 5 in the direction of the thickness of the door during up-and-down movement is restricted at only three points as in the first embodiment. Therefore, the windowpane 5 can be smoothly lifted and lowered without being twisted.

Figure 12:
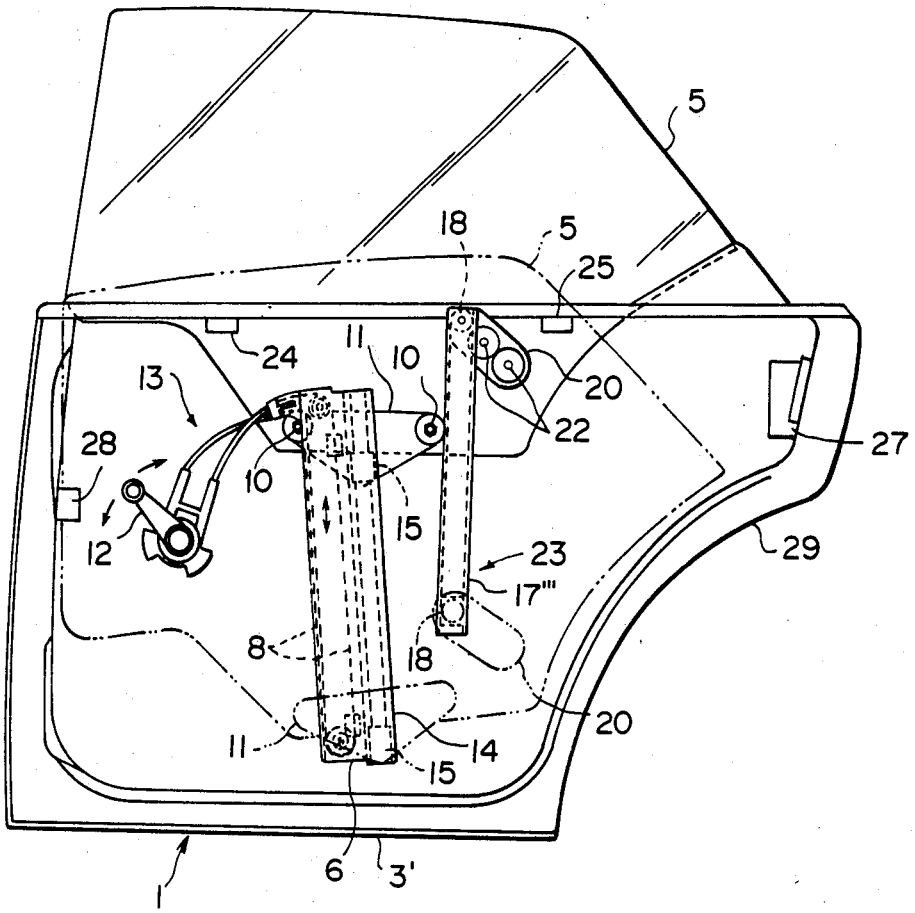
FIG. 12 is a view similar to FIG. 10 but showing a modification of the second embodiment.

Though in the second embodiment shown in FIGS. 10 and 11, the second guide rail member 17 is bent and disposed forward of the first guide rail member 14, the second guide rail member may be linear and may be disposed rearward of the first guide rail member as indicated at 17''' in FIG. 12. In this case, the linear second guide rail member 17''' is disposed in nonparallel to the first guide rail member 14 so that the distance therebetween is reduced downwardly.

I claim:

1. A windowpane lifting mechanism for a window of a vehicle door comprising a windowpane driving means including a cable member which is provided to vertically extend in a door shell and connected to a lower end portion of a windowpane by way of a connecting member so that the windowpane is moved up and down to close and open the window in response to up-and-down running of the cable member, and a windowpane guiding means including a first guide rail member which is provided on one side of cable member to linearly extend substantially in the vertical direction, a second guide rail member provided to extend substantially in the vertical direction in nonparallel relation to the first guide rail member spaced therefrom by a predetermined distance in fhe direction of width of the windowpane, a first slider connected to a lower portion of the windowpane and engaged with the first guide rail member to be slidable along the first guide rail member, and a second slider connected to a lower portion of the windowpane at a distance from the first slider and engaged with the second guide rail member to be slidable along the second guide rail member, wherein said first guide rail member is disposed near said cable member and extends linearly in the vertical direction in parallel to said cable member, and wherein said first slider is supported so as not to be displaced in the direction of thickness of the door, and wherein second slider is supported so as to be able to be displaced in the direction of thickness of the door, wherein said second slider is displaced under heavy load, but is hardly displaced uunder light load.

2. A windowpane lifting mechanism as defined in claim 1 in which said second guide rail member is bent so that the windowpane is guided to be once inclined forward and then erected toward the original upright position as the windowpane is lowered.

3. A windowpane lifting mechanism as defined in claim 2 in which said door panel is formed with a cutaway portion for accommodating a tire house in the rear lower portion thereof, and the windowpane is inclined forward about said first slider so that the windowpane is not interfered with by the wall portion of the door panel defining the cutaway portion as it is lowered.

4. A windowpane lifting mechanism as defined in claim 2 in which a door lock is provided in a rear portion in said door panel and the windowpane is inclined forward about said first slider so that the windowpane is not interfered with by the door lock as it is lowered.

5. A windowpane lifting mechanism as defined in claim 1 in which said second guide rail member linearly extends and is disposed in nonparallel relation to the first guide rail member so that the windowpane is guided to be inclined forward when it is lowered.

6. A windowpane lifting mechanism as defined in claim 5 in which said door shell is formed with a cutaway portion for accommodating a tire house in the rear lower portion thereof, and the windowpane is inclined forward about said first slider so that the windowpane is not interfered with by the wall portion of the door shell defining the cutaway portion as it is lowered.

7. A windowpane lifting mechanism as defined in claim 5 in which a door lock is provided in a rear portion in said door shell and the windowpane is inclined forward about said first slider so that the windowpane is not interfered with by the door lock as it is lowered.

8. A windowpane lifting mechanism as defined in claim 5 in which said second guide rail member is positioned rearward of the first guide rail member and so that the distance therebetween is reduced toward the lower ends thereof.

9. A windowpane lifting mechanism for a window of a vehicle door comprising a windowpane driving means including a cable member which is provided to vertically extend in a door shell and connected to a lower end portion of a windowpane by way of a connecting member so that the windowpane is moved up and down to close and open the window in response to up-and-down running of the cable member, and a windowpane guiding means including a first guide rail member which is provided on one side of the cable member to linearly extend substantially in the vertical direction, a second guide rail member provided to extend substantially in the vertical direction in nonparallel relation to the first guide rail member spaced therefrom by a predetermined distance in the direction of width of the windowpane, a first slider connected to a lower portion of the windowpane and engaged with the first guide rail member to be slidable along the first guide rail member, and a second slider connected to a lower portion of the windowpane at a distance from the first slider and engaged with the second guide rail member to be slidable a long the second guide rail member, in which one of said first and second sliders is arranged so as not to permit displacement of the windowpane in the direction of thickness of the door during up-and down movement of the windowpane and the other slider is arranged to permit displacement of the windowpane in the direction of thickness of the door during up-and-down movement of the windowpane, and two pairs of stabilizers are provided adjacent to the upper edge of the door panel, the pairs of stabilizers being spaced from each other in the direction of width of the windowpane and the stabilizers of each pair being opposed to each other on opposite sides of the windowpane and being in a sliding contact with the windowpane to restrict displacement of the windowpane in the direction of thickness of the door.

10. A windowpane lifting mechanism as defined in claim 9 in which said one slider is the second slider and said the other slider is the first slider.

11. A windowpane lifting mechanism as defined in claim 10 in which said second guide rail member is provided with a guide groove extending substantially vertically.

12. A windowpane lifting mechanism as defined in claim 11 in which said second slider is in the form of a sheave having a peripheral groove engaged with the second guide rail member to permit sliding movement of the second slider along the guide groove and not to permit movement of the second slider in the direction of thickness of the door, and the sheave is connected to the windowpane by way of a connecting shaft projecting from a bracket fixed to the windowpane in the direction of thickness of the door, the sheave being supported on the connecting shaft for both rotation and sliding movement in the axial direction of the connecting shaft, thereby permitting displacement of the windowpane in the direction of the thickness of the door.

13. A windowpane lifting mechanism as defined in claim 11 in which said second slider is in the form of a cylindrical roller fit into the guide groove of the second guide rail member to be slidable both along the guide groove and in the axial direction thereof.

14. A windowpane lifting mechanism as defined in claim 10 in which said second guide rail member is a channel member which has a U-shaped cross section having an open side and a closed bottom opposed to the open side, said second slider being received in the second guide rail member from the open side to be slidable toward and away from the closed bottom, thereby permitting displacement of the windowpane in the direction of the thickness of the door.

15. A windowpane lifting mechanism as defined in claim 10 in which said first guide rail member is a channel member which has a C-shaped cross section having an open side and a closed bottom opposed to the open side, the open side being partly olosed by opposed flange portions, said first slider being received in the first guide rail member from the open side and sliding movement of the first slider toward and away from the closed bottom being prevented by the opposed flange portions, thereby preventing displacement of the windowpane in the direction of the thickness of the door.

16. A windowpane lifting mechanism as defined in claim 9 in which each of said stabilizers comprises a base portion and a Teflon bristle cloth having lubricity and bonded to the base portion.

17. A windowpane lifting mechanism as defined in claim 9 in which each of said stabilizers comprises a roller member.

18. A windowpane lifting mechanism for a window of a vehicle door comprising a windowpane driving means including a cable member which is provided to vertically extend in a door shell and connected to a lower end portion of a windowpane by way of a connecting member so that the windowpane is moved up and down to close and open the window in response to up-and-down running of the cable member, and a windowpane guiding means including a first guide rail member which is provided on one side of the cable member to linearly extend substantially in the vertical direction, a second guide rail member provided to extend substantially in the vertical direction in nonparallel relation to the first guide rail member spaced therefrom by a predetermined distance in the direction of width of the windowpane, a first slider connected to a lower portion of the windowpane and engaged with the first guide rail member to be slidable along the first guide rail member, and a second slider connected to a lower portion of the windowpane at a distance from the first slider and engaged with the second guide rail member to be slidable along the second guide rail member, in which said door shell is provided with a guide member which holds the front edge portion of the windowpane and restricts displacement of the front edge portion in the direction of thickness of the door.

19. A windowpane lifting mechanism for a window of a vehicle door comprising a windowpane driving means including a cable member which is provided to vertically extend in a door shell and connected to a lower end portion of a windowpane by way of a connecting member so that the windowpane is moved up and down to close and open the window in response to up-and-down running of the cable member, and a windowpane guiding means including a first guide rail member which is provided on one side of the cable member to linearly extend substantially in the vertical direction, a second guide rail member provided to extend substantially in the vertical direction in nonparallel relation to the first guide rail member spaced therefrom by a predetermined distance in the direction of width of the windowpane, a first slider connected to a lower portion of the windowpane and engaged with the first guide rail member to be slidable along the first guide rail member, and a second slider connected to a lower portion of the windowpane at a distance from the first slider and engaged with the second guide rail member to be slidable along the second guide rail member, in which said cable member extends along a regulator base provided in the door shell, and said first guide rail member is formed integrally with the regulator base.

20. A windowpane lifting mechanism as defined in claim 19 in which said first guide rail member and the regulator base are integrally formed from a single plate member.

* * * * *